US005237947A

United States Patent [19]

Manning

[11] Patent Number: 5,237,947

[45] Date of Patent: Aug. 24, 1993

[54] VARIABLE DRAFT HULL

[75] Inventor: Michael F. Manning, Columbia, Md.

[73] Assignee: The United States of America as represented by the Secretary of the Navy, Washington, D.C.

[21] Appl. No.: 923,431

[22] Filed: Aug. 3, 1992

[51] Int. Cl.[5] ..... B63B 35/72

[52] U.S. Cl. ..... 114/61; 114/125; 114/274; 114/283

[58] Field of Search ..... 114/39.1, 39.2, 61, 114/123, 274, 283, 121, 122, 125

[56] References Cited

U.S. PATENT DOCUMENTS

| | | | |
|---|---|---|---|
| 3,541,987 | 11/1970 | Barkley | 114/61 |
| 4,286,534 | 9/1981 | Sanner | 114/61 |
| 4,494,472 | 1/1985 | Rougerie | 114/61 |
| 4,565,145 | 1/1986 | Mayall et al. | 114/61 |
| 4,660,492 | 4/1987 | Schlichthorst et al. | 114/61 |

*Primary Examiner*—Jesus D. Sotelo
*Assistant Examiner*—Stephen P. Avila
*Attorney, Agent, or Firm*—Charles D. Miller

[57] ABSTRACT

A hull for a water-borne vessel includes submersible variable displacement pods attached to a main hull of the vessel through pivotable arms which allow positioning of the submersible pods at locations within a range of horizontal and vertical locations. The variable displacement pods also include hydrofoils and other controllable surfaces to provide dynamic lift and attitude control of the vessel. A gearing arrangement is provided to maintain or selectively change the orientation of the pods or portions thereof at different angular positions of the pivotable arms. Support for the vessel can thus be controllably proportioned among both static displacement and dynamic lift of the main hull and the variable displacement pods as well as through dynamic lift of foils or planes.

16 Claims, 3 Drawing Sheets

VARIABLE DRAFT HULL

STATEMENT OF GOVERNMENT INTEREST

The invention described herein may be manufactured and used by or for the Government of the United States of America for governmental purposes without the payment of any royalties therein or therefor.

BACKGROUND OF THE INVENTION

1. Field of the Invention

The present invention generally relates to the design of hulls for watercraft and, more particularly, to hull designs which are reconfigurable for alteration of operational characteristics thereof.

2. Description of the Prior Art

Waterborne vessels have been used since ancient times and for many purposes. The need for vessels to perform in a variety of water and weather conditions and the various purposes for which such vessels have been intended has led to a great variety of hull designs. In particular, the often conflicting requirements for operation in shallow water and under a variety of weather and water conditions and at high speed has led to the development of hydrofoil designs.

Hydrofoils function to increase speed by decreasing the wetted area of hulls by producing lift sufficient to support the main hull (hereafter sometimes referred to as a displacement hull for the purpose of indicating that it is a source of static lift for the vessel) of the vessel above the water and, in general, have been relatively successful for passenger service and the transporting of relatively light loads. However, the need to generate sufficient lift to entirely replace the function of the displacement hull as a means for supporting the vessel requires relatively high speeds which increases fuel consumption and reduces the range of the vessel. Further, the structure required to produce such lift increases with the displacement of the vessel and the size of vessels to which hydrofoils can be applied has, as a practical matter, been relatively limited. Such structures also increase the effective draft of the vessel, particularly in the hull-borne mode of operation and compromise the ability of such a vessel to operate in shallow water.

As an alternative for the purpose of extending the potential of hydrofoils to larger vessels, the so-called hybrid hydrofoil concept has recently received substantial interest. This type of design uses one or more submerged hulls or pods connected to the vessel by one or more struts as a structural base upon which hydrofoils can be mounted. The pod can be used to carry fuel and/or motive power systems and preferably provide some positive static buoyancy for the vessel. By providing a significant amount of support for the vessel by the static buoyancy of the pod, the hydrofoils are thus required to provide less dynamic lift, often only on the order of 30%-70% of the displacement of the entire vessel.

A particular design for a hybrid hydrofoil configuration has included a single pod with counter-rotating propellers (possibly co-axial) connected to the displacement hull of the vessel by a single narrow strut running a substantial portion of the length of the vessel. Two pair of foils, each equipped with flaps for producing lift and dynamic stabilization of the vessel are provided near the fore and aft ends of the pod. By the combination of providing a portion of the vessel support through the static buoyancy to the pod and merely using the foils to lift the displacement hull from the water, reducing wetted area of the combination hull of the vessel, the latitude of operating conditions has been increased.

Other designs have been used for particular purposes. In particular, so-called catamaran, trimaran and other multi-hull designs have been used effectively to decrease hull draft and effectively decrease the beam to provide increased lateral stability of the vessel. Catamaran and trimaran hull designs, while increasing wetted area, often provide increased speed since the beam of each of the plural hulls can be made smaller, presenting reduced total frontal area of the vessel. However, maneuverability is often reduced in such multi-hull designs.

General principles of multi-hull designs have also been proposed for implementation in hybrid hydrofoil designs by providing one or more pods for a vessel displacement hull. However, by the general nature of any hydrofoil design which must provide for lift of the vessel, the benefits of shallow draft of multi-hull designs is usually lost, particularly in the hull-borne mode of operation. Further, for applications which require the vessel to have a shallow draft, the hybrid hydrofoil, by utilizing the pods for propulsion, present a substantial risk of propeller damage or fouling.

Operation on shallow waterways such as lakes and rivers, portions of which may be only marginally navigable, are a typical application which requires a vessel to have a shallow draft. In some applications, it is preferable not only to minimize draft but also to provide for propulsion above the water surface such as with a ducted fan to avoid interaction with the bottom. In such cases, directional control is often provided by redirection of thrust such as with an air rudder. However, shallow draft reduces the stability and controllability of such a vessel. Shallow draft may also reduce the ability of the vessel to hold course during high wind and adverse sea conditions. Under such conditions it is preferable to have substantial wetted hull area.

SUMMARY OF THE INVENTION

It is therefore an object of the present invention to provide a vessel having a reconfigurable hull in order to accommodate a variety of operational conditions while providing very high performance, stability and maneuverability.

It is another object of the present invention to provide a vessel capable of operating in shallow water as well as under adverse conditions of sea and weather in deep and/or unprotected waters.

It is a further object of the present invention to provide a vessel hull which exhibits the advantages of a hybrid hydrofoil while allowing alteration, at will, of the static and dynamic buoyancy of the displacement hull and the submersible hull and the dynamic lift of the hydrofoil consistent with the ability to operate in shallow water.

In order to accomplish these and other objects of the invention, a variable draft hull is provided including, in combination, a main hull, at least two variable displacement pods and means for positioning the two variable displacement pods over a range of horizontal and vertical positions in relation to said main hull.

In accordance with another aspect of the invention, portions of the pods and the foils can be relatively rotated relative to body portions of the pods.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
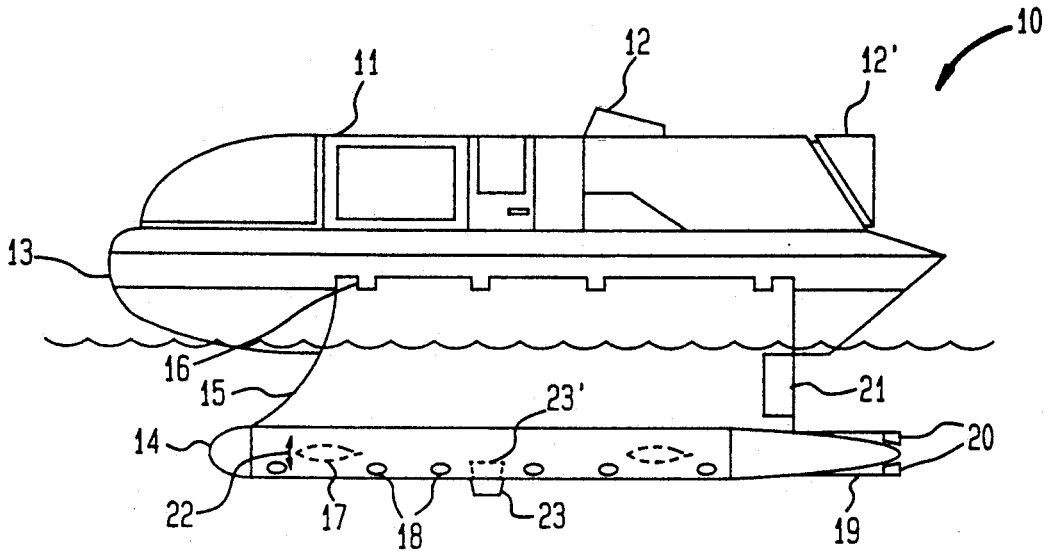
FIG. 1 is a side view of a variable draft hull in accordance with the present invention.
Figure 2:
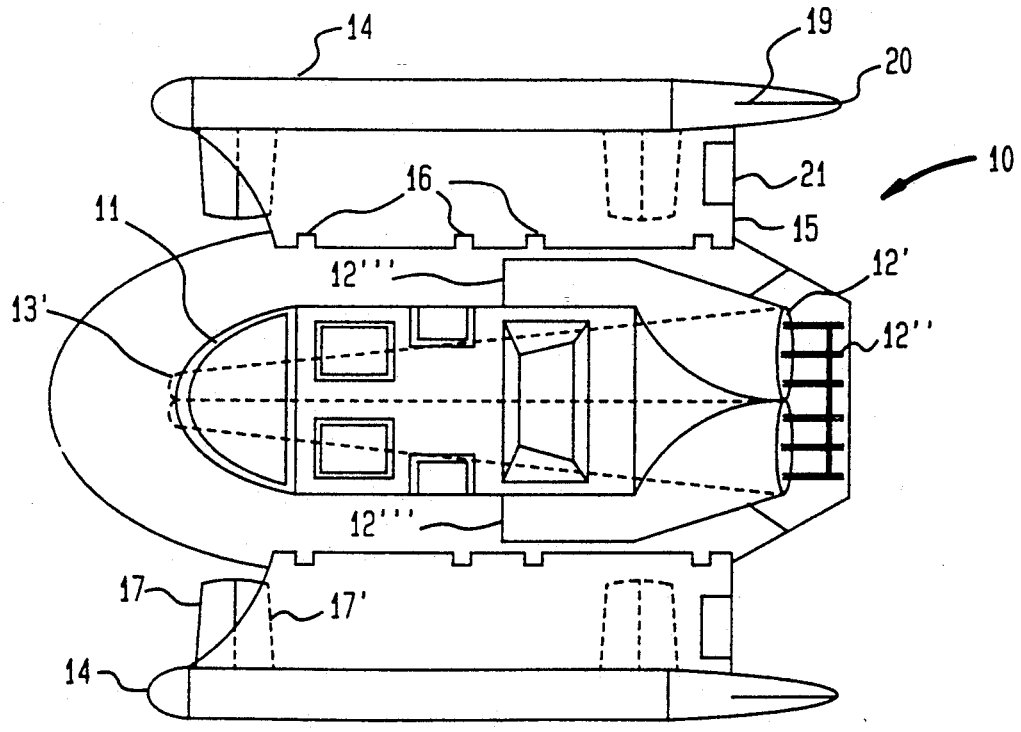
FIG. 2 is a top view of a variable draft hull shown in FIG. 1, FIGS. 3 and 4 schematically illustrate different configurations of the variable draft hull in accordance with the invention.

Referring now to the drawings, and more particularly to FIG. 1, there is shown a side view of a preferred hull 10 in accordance with the present invention. A top view of the same hull is shown in FIG. 2. Insofar as possible, the same reference numerals will be used in both Figures. It is to be understood that the details of superstructure 11 are illustrated only for assisting visualization of the overall concept and are relatively unimportant to the practice of the invention. However, it is preferred that the superstructure 11, regardless of design or configuration, be constructed of lightweight materials, such as fiberglass, to reduce weight and to be of streamlined form to reduce aerodynamic drag at high speeds.

The lower portion of hull 13 is preferably of a planing design although the details of the same are also not critical to the practice of the invention. It is important to the shallow draft operation of the vessel that the bottom be relatively flat in order to reduce draft in the hull-borne mode of operation. It is also preferred that the bottom of hull 13 be shaped with longitudinal grooves 13', sometimes referred to as tunnels, symmetrically and generally in parallel to the axis of the hull, to increase directional stability and planing performance of the hull. It should be noted that the term "displacement hull" is not intended to infer any particular feature or features of the shape thereof (e.g. as opposed to a "planing hull", which is, in fact, preferred) but only that the displacement of the hull is a potential source of static support for the weight of the vessel. Such shapes are known, per se, and some enhance planing by directing air under the hull. Propulsion is provided through a jet or ducted fan having an air intake 12 and exhaust 12' which may preferably include a directional deflector, shown at 12'', in FIG. 2, for directional control of the vessel although the propulsion system details are, likewise relatively unimportant to the practice of the invention. For short radius turns and for maneuvering in relatively restricted areas, directional ports 20''' are also provided on the port and starboard sides of the superstructure 11 which can be used with the directional deflectors 12''. When these directional ports 12''' are opened in conjunction with closure or partial closure of exhaust port 12', reverse thrust is developed. As indicated above, propulsion above the water surface is preferred to avoid disturbance of the bottom of the body of water when the vessel is operated in shallow areas.

Perhaps the most salient feature of the hull design of FIGS. 1 and 2 is the pods 14 supported on variable position arms 15. Arms 15 are hinged to the displacement hull 13 preferably along their entire length as indicated at 16. Thus the lateral separation and the depth of submersion of the pods 14 relative to hull 13 may be controlled by pivoting of arms 15. As will be discussed in greater detail below, electrical control through electric motors and gearing is preferred to pneumatic and hydraulic systems for pivoting of arms 15 both because of lighter weight and the better aerodynamic profile presented. Gearing also provides for complementary motion of foils 17 relative to the pods as the arms 15 are moved. Alternatively, complementary or independent pod rotation can be achieved through locally placed motors and gearing as will be discussed in greater detail below in connection with FIGS. 6 and 7.

Additionally, pods 14 are of variable displacement in accordance with the invention and may be wholly or partially flooded through apertures 18 to alter the buoyancy thereof and of the overall vessel. The pods are also preferably equipped with fins 19 and water rudders 20 which preferably do not extend beyond the outer contour of the pods 14 to avoid increasing draft of the vessel. Additional rudder area 21 is also preferably provided on arms 15 which may function in either air or water or a combination of air and water, depending on the vessel draft in any particular mode of operation. Additionally, to reduce yaw and increase stability during high speed turns, the pods can also be fitted with selectively deployable turning fins, shown in deployed position at 23 and in retracted position at 23'.

As particularly seen in FIG. 2, hydrofoils 17 which may be controllably pivotable planes as indicated by arrow 22 in FIG. 1 or may, alternatively, include controllable elevator panels 17 extend horizontally inwardly of the pods 14. Similar panels could be positioned to extend outwardly but such a configuration is not preferred since extension beyond the major structure of the vessel subjects them to damage although the control moment would be greater and could improve the roll stability of the vessel more easily than with the preferred inward configuration.

As an alternative to hydrofoils 17, dynamic lift could also be generated through the shape of the pods 17 by, for example, providing an inclined lower surface thereof. However, hydrofoils 17 would be desirable even in this case to provide enhanced roll and pitch stability and fine control of the lift so generated.

Figure 3:
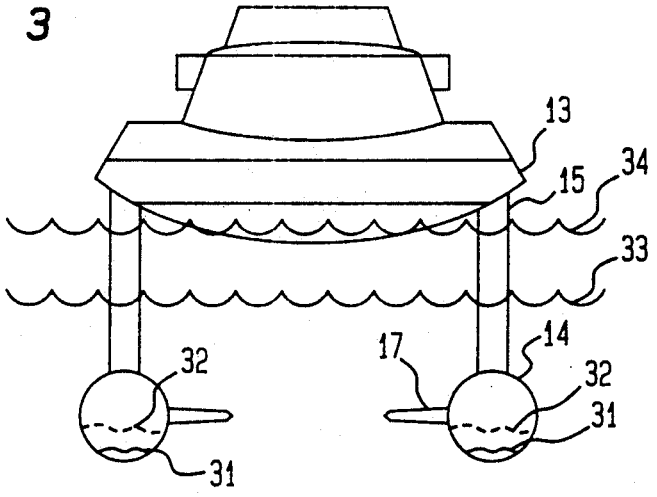
Figure 4:
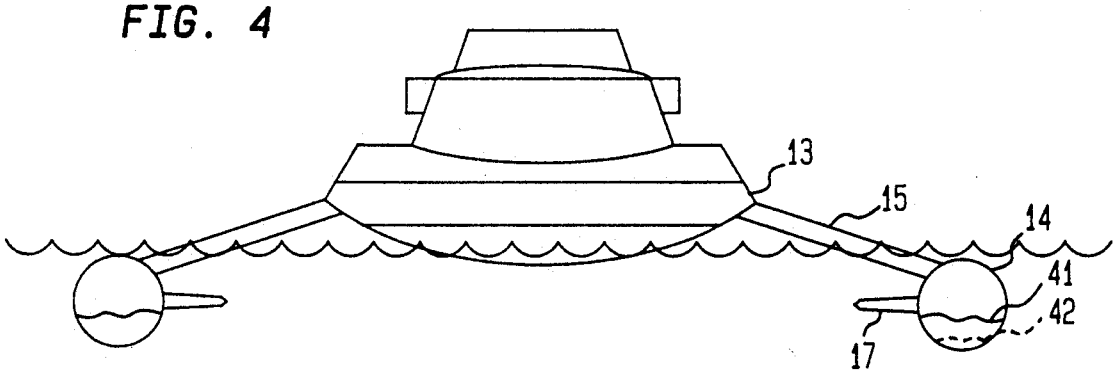

Referring now to FIGS. 3 and 4, the reconfiguration of the hull and the effects thereof will now be discussed. Both FIG. 3 and FIG. 4 are front views of the reconfigurable hull in accordance with the invention and are chosen to be illustrative of extremes of hull reconfiguration and not necessarily preferred configurations for any particular operating conditions. In FIG. 3, the arms 15 are positioned downwardly and the buoyancy of the pods is substantially maximized by driving out water as shown at 31 with pressurized air preferably pumped through tubing 57 (shown in FIG. 5) in the arms 15 from a compressor located in the hull 13, as will be discussed in greater detail with reference to FIG. 5. The static buoyancy of the pods, in this case is sufficient to raise the displacement/main hull 13 completely above the water surface 33. It should be noted that this configuration and positioning of the entire vessel could be achieved dynamically by lift from foils 17 and, in fact, is generally preferred for high speed operation. The same general configuration but with decreased pod buoyancy as indicated by water levels at 32 and 34 is also preferred for operation in the hull-borne mode in deep water and/or heavy sea conditions. In this latter case, generally indicated by water surface level 34, lateral and bottom surfaces of displacement hull 13 as well as arms 15 and pods 14 are wetted for increased lateral stability. The lower profile of the overall vessel may be advantageously exploited to reduce the effects of high wind conditions. The height of the vessel profile may be adjusted as desired and may compensate for payloads of differing weights by altering the buoyancy of the pods 14. Further, with the water level at 34, rudder areas 21 engage the water for enhanced directional control.

In FIG. 4, the arms 14 are fully extended to the sides and the buoyancy adjusted as shown at 41 so that the pods 14 are slightly below water level and the displacement hull 13 has only a slight engagement with the water surface. This configuration optimizes lateral and roll stability by maximizing the effective beam of vessel 10. This configuration is also optimum for planing of the displacement hull and/or obtaining additional lift from foils 17 for high speed operation in shallow waters. Overall draft can also be adjusted statically or at low speed by increasing the effective displacement of the pods by driving the water level therein to level 42 and which may also lift the displacement hull clear of the water surface.

In summary, therefore, it is seen that the support of the vessel and payloads of differing weights can be provided through any combination of four factors: hull displacement, dynamic lift of the planing form of the displacement hull, pod displacement and foil dynamic lift. At the same time, the respective wetted areas of the displacement hull 13 and arms 15 is variable at will, as is the effective beam of the vessel. Thus the vessel can be substantially optimized for a wide variety of operating conditions in regard to speed, payload weight, water depth, and wave and wind conditions.

Figure 5:
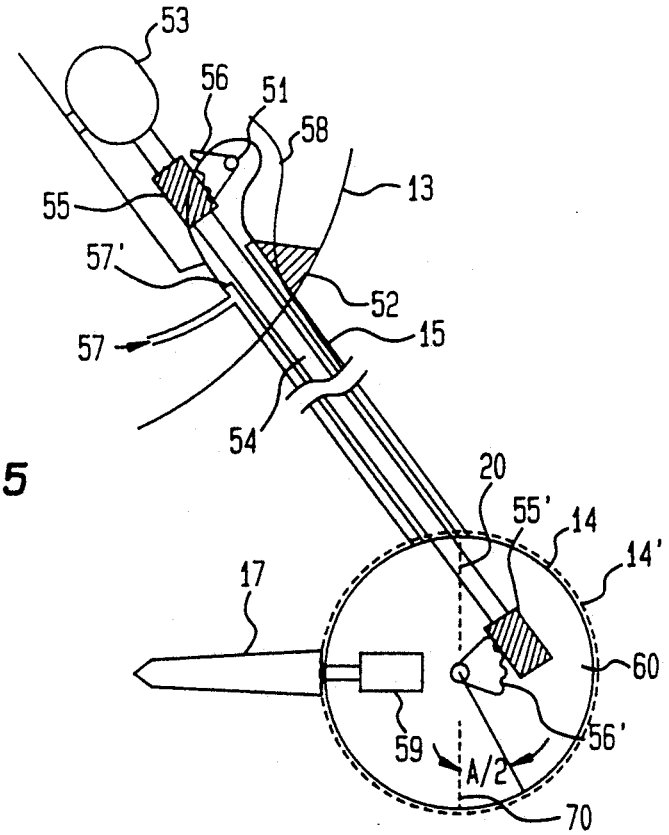
FIG. 5 illustrates the mechanism for counter-rotation of the pods of the variable displacement hull as the hull is reconfigured.

Numerous mechanisms could be used for movement of the arms 15 for reconfiguration of the hull 10 in accordance with the present invention. However, one arrangement for doing so is schematically shown in FIG. 5. A portion of the hull cross-section is also identified with reference numeral 13. Since the lifting function of foils 17 and the water rudders 20 will be optimized if these surfaces are maintained parallel and perpendicular to the water surface, respectively, and the pod body is rotated through the same angle as the motion of arms 15, these surfaces must also be counter-rotated through the same angle with respect to arms 15. Therefore, the pod is structurally divided into two relatively rotatable portions 14 and 14'. Pod body portion 14 is indicated as being affixed to arms 15 while pod portion 14', which includes the bow or stern or the pod, or both, provides for the complementary relative rotation of foils 17, fins 19, rudders 20 and possibly apertures 18.

It should be noted that if rotation of apertures 18 is not provided, the apertures should be placed on the rotating pod body portion 14 to be at equally low positions at both extremes of motion of arms 15. For example, if the arms rotate through an angle A, the apertures 18 should be located at a position at an angle A/2 to the outside of the bottom of pod 14 when the arm 15 is extended. Thus, when the arms are retracted to the configuration shown in FIG. 3, the apertures 18 will be at an angle A/2 to the inside of the bottom of the rotating pod. This would provide for maximum pod buoyancy at an intermediate arm angle and minimize the effect on maximum buoyancy at all other intermediate arm angles.

Since the arms may be required to carry the entire weight of the vessel as well as acceleration forces in the vertical direction when the vessel is underway and at high speed, the load which must be carried by the arm movement mechanism may be quite large. It is also preferable that the arm position be effectively self-locking at any desired position and require no power to maintain that position. This is also desirable in the event of engine failure when the configuration must not uncontrollably change and which may require the configuration to be changed manually.

The arm movement arrangement 50, shown in FIG. 5, satisfies all of these requirements by providing a pivot 51 as a portion of hinge 16 at or near the surface of hull 13. Since the moment is greatest when the arms are fully extended, additional arm support blocks 52 are also preferably provided to relieve the stress on the arm movement arrangement at that position. If required by the arm length, vessel weight and anticipated operational loads, support blocks could be arranged to support the arms at several different angular positions such as by providing a pin which could be moved to one of several different positions.

The arm movement arrangement of FIG. 5 preferably includes a drive shaft 54 which extends through the hollow cross-section of arm 15. This drive shaft is preferably turned by means of an electric motor 53 connected thereto, possibly through gearing. It is also preferable to provide for manual turning of shaft 54 under emergency conditions. Both input and output ends of the drive shaft 54 are fitted with a worm gear 55, 55' which engage respective sector gears 56, 56'. The angular extent of these sector gears should correspond to the angular range of movement of arms 15 which could be 90° (e.g. vertical to horizontal) or more. To achieve minimum draft of the overall vessel, the extent of travel of arms 15 should be sufficient to lift the bottoms of pods 14 at least to the level of the bottom of hull 13 in order to distribute the weight of the vessel over the maximum volume of the hull. It may also be desirable to provide for the pods to be lifted above the water surface for maintenance and other purposes. In such a case, it would be desirable to provide that support blocks 52 could be removed or shifted in position to allow such extended travel range.

Sector gear 56 is affixed to the hull 13 of the vessel and sector gear 56' is affixed to the frame 60 of pod portion 14', which carries the structure such as foil 17 and servomotors 59 for controlling the foils in accordance with signals over cable 58, which must receive counter-rotation and, for structural simplicity, preferably a ring-shaped or end portion of the pod portion from which foil 17 and other control and stabilization surfaces extend. Thus, as shaft 54 is rotated, complementary motions of arm 15 and pod portion 14' are achieved. The mechanical advantage provided by the shallow slope of the worm gear surfaces effectively provides locking of both arm position and pod portion position at any location within the range of arm travel.

Figure 6:
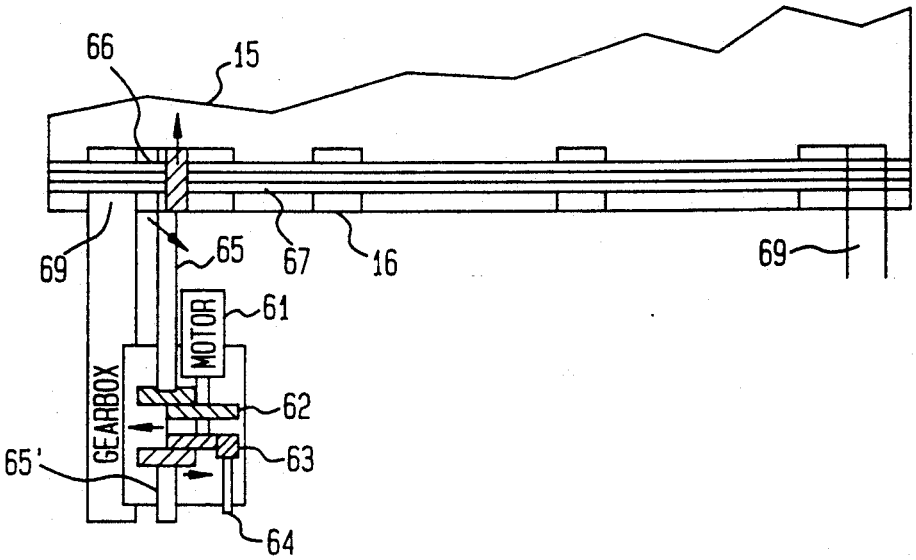
FIG. 6 illustrates an alternative arrangement for altering arm position.

It should be understood that the arrangement of FIG. 5 or other alternative arm motion arrangement should be provided on both sides of the vessel and may be replicated as many times as desired on each side of the vessel to bring loads within ranges which can be carried by each such arrangement. Synchronization of motors 53 is preferably provided to prevent binding between such plural arrangements. Alternatively, all drive shafts 54 can be geared together and commonly driven from a single motor as shown in FIG. 6 or a motor for each side of the vessel. Such a gearing arrangement is, in fact, preferable to avoid the occurrence of mechanical binding when it may be necessary to operate the system manually.

Figure 7:
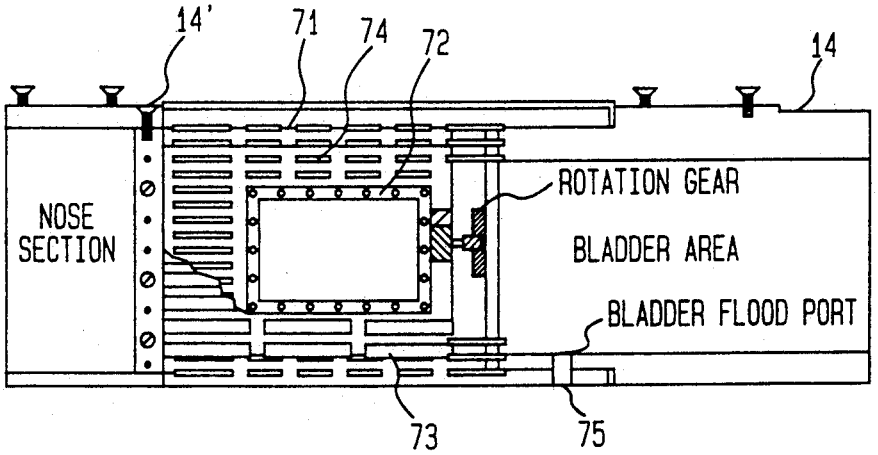
FIGS. 7 and 8 illustrate side and top views, respectively, of an alternative arrangement for rotating portions of the pods.
Figure 8:
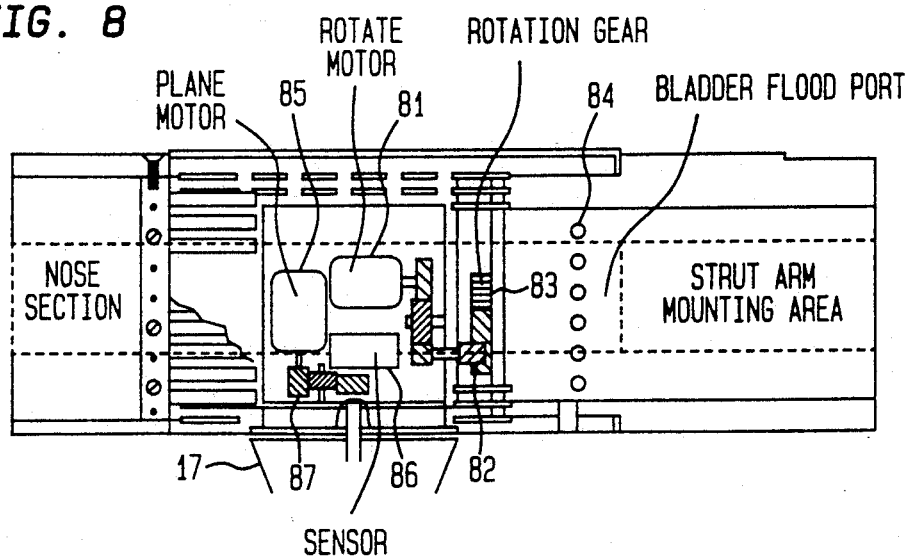

Referring now to FIGS. 6, 7 and 8, an alternative, preferred arrangement for achieving separate control of arm position movement and counter-rotation of pod portions 14' will now be explained. The basic difference between the arrangements of FIGS. 7 and 8 from FIG. 5 is the ability to independently control counter-rotation of the pod portions 14', either for additional maneuverability or to provide roll stability by providing adjustable dihedral relative positioning of the starboard and port pod foils 17 on the bow, stern or both portions 14' of each pod.

The gear and shaft drive of FIG. 6 can be used with either the pod counter-rotation arrangement of FIG. 5 or that of FIGS. 7 and 8. It is also to be understood that some details omitted for clarity in FIG. 5 but shown in FIGS. 7 and 8 could also be implemented in the arrangement of FIG. 5, such as the use of roller bearings or the rotating flood port and bladder design.

In FIG. 6, a single motor 61 is provided for commonly positioning both movable arms 15 simultaneously. The motor 61 is attached to a reduction gearing arrangement 62 to increase available torque in output shaft 65 which terminates preferably in a worm gear which drive sector gear 66 attached to splined shaft 67. Splined shaft could then be coupled to shaft 54 of FIG. 5 or coupled periodically to movable arm 15 to provide distribution of the moment of arm 15 over its length, as is preferable in the embodiment of FIGS. 7 and 8. The ends of splined shaft 67 are carried in fore and aft bearing block 69, 69' also cooperate with hinges 16 in a manner not critical to an understanding of the invention. It should be noted however that the torsion bar thus provided allows for some smoothing of the vessel motion at high speed, if desired, by moving the arms away from stops 52. A similar arrangement is provided for the other movable arm 14, driven through shaft 65'. Additional gearing is provided at 63 so that rotation (e.g. manually) of shaft 64 can also be used to position the movable arms.

A preferred construction for the rotatable pod portions 14' is shown in a side view in FIG. 7 and a top view in FIG. 8. In the embodiment shown in these Figures, pod body portion 14 includes an extended cylindrical end portion 71 having roller bearings 73 on the outer surfaces thereof which engage the interior of the shell or ring or the relatively rotatable section 14'. While the nose section is illustrated, it is to be understood that the same mechanism is preferably provided on the stern section of the pod.

The cylindrical portion 71 of pod body 14 also preferably carries an internal roller bearing 74 which provides for relative rotation of a structural member preferably in the form of a watertight servo box. As shown in FIG. 8, this watertight servo or servomotor box includes at least one motor 81 for rotating the servo box relative to pod body portion 14 through a gear train 82, a final stage 83 of which is attached to the pod body portion 14. Another similar servo motor and gear train, not shown in the interest of clarity, can be provided to relatively rotate pod portion 14' relative to the watertight servo box 72 for positioning an outer bladder flood port with one or more apertures 84 connecting with a chamber containing a bladder which may be flooded to increase buoyancy. The ability to selectively position bladder flood port position at the bottom of the pod ensures that maximum buoyancy can be obtained from the pods since water cannot be fully driven out from the pod body 14 at locations below flood port 75. It should also be noted that the provision of the servomotor box 72 as an intermediate element of three relatively rotatable elements (14, 72 and 14') is desirable since the servomotor box will carry the load of the planes or foils 17 when operated through plane servomotor 85, position feedback sensor 86 (which is also preferably provided for the rotation motor or motors 81) and gear train 87, but the nose or stern portion 14' will not.

Alternatively, it should be understood that relative rotation of pod portion 14' and servomotor box 72 need not be provided. However, if the planes and the flood port were rotated together, maximum buoyancy would not be obtainable unless the servomotor box was rotated such that the planes 17 were horizontal. On the other hand, it may be desirable to provide dihedral between the port and starboard planes or even rotate the planes into a vertical position (e.g. to substitute for or supplement the turning fins 23) to increase maneuverability where shallow draft is not necessary. In such a case, at high speed, it would be preferable to avoid changes in pod buoyancy with rotation of the rotational positions of the planes 17 as might be the case if pod portion 14' and the servomotor box 72 were fixed together and commonly rotated relative to pod body portion 14.

In view of the foregoing, it is evident that the variable draft hull in accordance with the present invention provides a vessel which is reconfigurable to meet a wide variety of water and weather conditions and efficient, high performance operation over a wide range of speeds and loads including operation in extremely shallow water. The arrangement for maintaining the operational orientation of control and dynamic lift generating surfaces on the pods allows extension of the proven principles of hybrid hydrofoil designs to reconfigurable hulls. The further provision of variable displacement of the pods further enhances optimization of stability in deep-water conditions and the ranges of loads which can be carried as well as providing additional buoyancy and decreasing draft in shallow water.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A variable draft hull including in combination:

a main hull, at least two variable displacement pods and means for positioning said at least two variable displacement pods over a range of horizontal and vertical positions in relation to said main hull, a first one of said variable displacement pods being positioned on a first side of said main hull and a second one of said variable displacement pods being positioned on a second side of said main hull;

each of said variable displacement pods further contains a bladder;

said means for positioning includes a first drive shaft extending from said main hull to said first one of said variable displacement pods said first drive shaft having a first worm gear rigidly affixed thereto;

said means for positioning further includes a second drive shaft extending from said main hull to said second one of said variable displacement pods, said second drive shaft having a second worm gear rigidly affixed thereto.

2. A variable draft hull as recited in claim 1, wherein said at least two variable displacement pods further include means for producing dynamic lift of said variable draft hull.

3. A variable draft hull as recited in claim 2, wherein said means for producing dynamic lift includes at least one hydrofoil on each of said at least two variable displacement pods.

4. A variable draft hull as recited in claim 3, wherein said at least one hydrofoil is controllably pivotable.

5. A variable draft hull as recited in claim 3, wherein said at least one hydrofoil includes a control surface.

6. A variable draft hull as recited in claim 1, wherein said at least two variable displacement pods are attached to said main hull through pivotable arms, said pivotable arms being movable through a range of angular positions with reference to said main hull.

7. A variable draft hull as recited in claim 6, further including means for rotating at least a portion of respective ones of said at least two variable displacement pods through an angle corresponding to an angular position of a respective one of said pivotable arms.

8. A variable draft hull as recited in claim 7, wherein said means for rotating at least a portion of respective ones of said at least two variable displacement pods includes a structural member supporting at least one servomotor and rotatable relative to a pod body portion attached to one said moveable arm.

9. A variable draft hull as recited in claim 8, wherein a pod portion other than said pod body portion is rotatable relative to said structural member.

10. A variable draft hull as recited in claim 7, wherein said means for rotating at least a portion of respective ones of said at least two variable displacement pods further includes means for rotating said first and second drive shafts.

11. A variable draft hull as recited in claim 10, wherein said means for rotating said drive shafts includes an electric motor.

12. A variable draft hull as recited in claim 10, wherein said at least two variable displacement pods further include means for producing dynamic lift of said variable draft hull.

13. A variable draft hull as recited in claim 12, wherein said means for producing dynamic lift includes at least one hydrofoil on each of said at least two variable displacement pods.

14. A variable draft hull as recited in claim 13, wherein said at least one hydrofoil is controllably pivotable.

15. A variable draft hull as recited in claim 13, wherein said at least one hydrofoil includes a control surface.

16. A variable draft hull as recited in claim 1 including at least one sector gear engaging one of said worm gears.

* * * * *